US012507792B2

(12) United States Patent
Ahrens

(10) Patent No.: US 12,507,792 B2
(45) Date of Patent: Dec. 30, 2025

(54) CAGE-TYPE BRUSH

(71) Applicant: HAIR4GOOD, LLC, Wilton, CT (US)

(72) Inventor: Mary Ahrens, Wilton, CT (US)

(73) Assignee: HAIR4GOOD, LLC, Wilton, CT (US)

( * ) Notice: Subject to any disclaimer, the term of this patent is extended or adjusted under 35 U.S.C. 154(b) by 905 days.

(21) Appl. No.: 17/414,605

(22) PCT Filed: Dec. 20, 2019

(86) PCT No.: PCT/US2019/067773
§ 371 (c)(1),
(2) Date: Jun. 16, 2021

(87) PCT Pub. No.: WO2020/132404
PCT Pub. Date: Jun. 25, 2020

(65) Prior Publication Data

US 2022/0047065 A1 Feb. 17, 2022

Related U.S. Application Data

(60) Provisional application No. 62/782,391, filed on Dec. 20, 2018.

(51) Int. Cl.
*A46B 9/02* (2006.01)
*A45D 1/04* (2006.01)
*A45D 20/48* (2006.01)

(52) U.S. Cl.
CPC ..... *A46B 9/023* (2013.01); *A45D 1/04* (2013.01); *A45D 20/48* (2013.01); *A46B 2200/104* (2013.01)

(58) Field of Classification Search
CPC ..... A45D 1/00; A45D 1/04; A45D 1/18; A45D 1/20; A45D 1/28; A45D 2/00; A45D 2/002; A45D 2/08; A45D 2/2471; A45D 2/2478; A45D 6/04; A45D 20/40; A45D 20/52; A45D 24/00; A45D 24/007; A45D 24/16; A45D 24/42; A45D 24/26; A45D 26/0033;
(Continued)

(56) References Cited

U.S. PATENT DOCUMENTS 4,167,192 A 9/1979 Arnold
5,877,600 A 3/1999 Wilk
(Continued)

*Primary Examiner* — Rachel R Steitz
*Assistant Examiner* — Karim Asqiriba
(74) *Attorney, Agent, or Firm* — Potomac Law Group, PLLC; Jamaica Potts Szeliga

(57) ABSTRACT

The present invention relates to a brush, comb, or hair appliance having a cage body comprising one or more functional inserts or plugs accommodated within the cage body containing bristles, teeth, or mini posts, such as loop posts and/or hook posts. Such cage-type hair tools may have no electricity or source of power, they may use traditional sources of power, or they may be heated by exposure to hot air, hot surfaces, or other heat sources. The one or more functional inserts within the cage body may be sized to move within the cage, made of a deformable and recoverable material, and/or have a specific shape to force into the cage body and expand to fill or overfill the cage body and may include hair additives, including but not limited to water, air, moisture, steam, liquids, fragrances, gels, mousses, foams, conditioners, keratin, oils, sprays, volumizers, softening agents, and/or powders.

9 Claims, 5 Drawing Sheets

(58) Field of Classification Search
CPC ..... A46B 7/00; A46B 7/02; A46B 7/026; A46B 7/04; A46B 7/06; A46B 7/10; A46B 17/00; A46B 17/02; A46B 17/04; A46B 9/00; A46B 9/02; A46B 9/08; A46B 9/10; A46B 9/12
See application file for complete search history.

(56) References Cited

U.S. PATENT DOCUMENTS

| | | | | |
|---|---|---|---|---|
| 5,979,463 | A * | 11/1999 | Santy, III | A45D 24/16 132/120 |
| 6,725,495 | B1 * | 4/2004 | Habibi | A46B 9/10 15/160 |
| 7,310,849 | B2 | 12/2007 | White et al. | |
| 8,215,319 | B2 | 7/2012 | Couillard | |
| 8,490,633 | B1 * | 7/2013 | Kennedy | A45D 20/00 34/96 |
| 2006/0042648 | A1 | 3/2006 | Teller | |
| 2010/0180908 | A1 * | 7/2010 | Leung | A45D 2/001 132/223 |
| 2014/0311510 | A1 * | 10/2014 | Putzer | A46B 9/10 132/223 |
| 2016/0286950 | A1 * | 10/2016 | DiPippo | A46B 9/023 |
| 2021/0007472 | A1 * | 1/2021 | Chu | A45D 20/52 |

* cited by examiner

CAGE-TYPE BRUSH

CROSS-REFERENCE TO RELATED APPLICATION

The present application is a National Stage application of International Application No. PCT/US2019/067773, filed Dec. 20, 2019, which claims priority to U.S. Provisional Patent Application No. 62/782,391, filed Dec. 20, 2018, both of which are incorporated by reference herein in their entireties.

FIELD OF TECHNOLOGY

The present invention relates a brush, comb, or hair appliance having a cage body comprising one or more functional inserts or plugs accommodated within the cage body. This cage-type hair tool can include any brush, comb, or hair appliance containing bristles, teeth, or mini posts, such as are loop posts and/or hook posts. Such cage-type hair tools may have no electricity or source of power, they may use traditional sources of power, or they may be heated by exposure to hot air, hot surfaces, or other heat sources. The one or more functional inserts within the cage body may be of any size or shape: such inserts may be sized to move within the cage or such inserts could be made of a deformable and recoverable material and/or having a specific shape so that it can be forced into the cage body and expand to fill or overfill the cage body. The functional insert may optionally include hair additives, including but not limited to water, air, moisture, steam, liquids, fragrances, gels, mousses, foams, conditioners, keratin, oils, sprays, volumizers, softening agents, powders, and the like.

BACKGROUND OF THE INVENTION

A variety of brushes and combs for hair are commercially available. Such brushes and combs have a supporting base and a plurality of projections, e.g. teeth or bristles, protruding from the supporting base. In general, the teeth of a comb are integrally formed with the supporting base with the same material. On the other hand, the bristles of a brush may be integrally formed with the supporting base, secured onto the supporting base, or removably mounted onto the supporting base. In combination with the bristles or teeth, or in lieu thereof, a brush or comb may have hair-smoothing surfaces, such as mini posts, e.g., loop posts and/or hook posts.

Hair appliances may also have brush and/or comb features. Hot air brushes and hair dryers, for example, release hot air over bristles or posts, allowing the user to simultaneously detangle, brush, and dry their hair. Other examples of hair appliances with brush or comb features include but are not limited to heated brushes and combs, hair rollers, and/or curling irons with bristles.

Bristles and teeth of conventional brushes, combs, and hair appliances are generally made of metallic material or plastic material that may hurt user's scalp. Brushes, combs, and hair appliances containing mini posts also typically have a defined orientation for such mini posts, i.e., there is no movement or reorientation of the mini posts as the hair is being combed or brushed.

During the hair brushing, combing, and/or styling processes, hair additives may be necessary or desired, including but not limited to water, air, moisture, steam, liquids, fragrances, gels, mousses, foams, conditioners, keratin, oils, sprays, volumizers, softening agents, powders, and the like. These hair additives are separate from the brushes, combs, or hair appliances, complicating and/or delaying the hair styling process as well as posing the potential for using too much and/or too little of said additive.

There is a need for brushes, combs, and hair appliances that may address the issues of scalp discomfort, lack of flexibility in the mini posts, and the need to separately apply hair additives.

SUMMARY OF THE INVENTION

The present invention is directed to cage-type tools, i.e., cage-type brushes, combs, and hair appliances, where one or more functional inserts may be placed within such cage, wherein the number of inserts, their size, their material, and their contents (if any), can assist the user in their hair styling goals.

Some embodiments of the cage-type tool of the present invention include, but are not limited to, hairbrushes, cushion brushes, paddle brushes, detangling brushes, detangling combs, and round brushes, as well as hair appliances having brush, comb, or mini post components, including but not limited to hot air hair brushes, curling irons with bristles, hair rollers, and heated hairbrushes and combs.

The cage-type tools of the present invention comprise a cage body, a handle, and one or more functional inserts. In some embodiments of the invention, the outer surface of the cage body may include bristles, teeth, mini posts, or a combination thereof. In other embodiments, bristles, teeth, and/or mini-posts may be distributed on the surface of the functional insert rather than the outer surface of the cage body. In further embodiments, the outer surfaces of both the cage body and the functional insert may contain bristles, teeth, and/or mini-posts. In the present invention, the bristles, teeth, and/or mini posts may be integrally formed with the outer surface of the cage body and/or the functional insert or may be attached by any affixing or assembly process known in the art.

In one embodiment of the present invention, the cage body may be integrally formed with the handle. In another embodiment, the cage body may be assembled to the handle. In further embodiments of the present invention, the cage body may form only a portion of the tool in that other surfaces and/or structures may be present with the cage body, including but not limited to surfaces and/or structures containing additional bristles, teeth, mini posts, and surfaces and/or structures that provide power, hot air, heat, and the like.

In one embodiment, the cage body of the cage-type tool is comprised of grids, including but not limited to elongated grids. In the present invention, the cage body of the cage-type tool may have grids spaced and arranged in any fashion that will retain the functional insert to be used within such cage body.

In another embodiment, the grids of the cage body extend to have protruding ends serving as bristles or teeth. In other embodiments, bristles, teeth, or mini posts are integrally formed with the cage body. In other embodiments, bristles, teeth, or mini posts are attached to or protruded through the outer surface of the cage body.

In the present invention, the cage body may take any three-dimensional shape, including but not limited to cylindrical, triangular, or other polygon shapes, as well as custom or irregularly shapes.

In some embodiments, the cage-type tool may have no electricity or other source of power. In other embodiments, the cage-type tool may have traditional sources of power, such as a battery component, e.g., a traditional chemical battery and/or a rechargeable battery, or a solar powered battery source, or, alternatively, the cage-type tool may be chargeable via a standard electrical plug, a usb cord, charging mat, or other charging devices. In further embodiments, the cage-type tool may be heated or powered but may have no source of power of their own. As an example, the cage-type tool may be heated by exposing the appliance to hot air, including but not limited to being heated by a blow dryer, air brush, or oven, or by exposing the appliance to other known sources of heating, including but not limited to being heated by using a microwave, hot plate, oven, stove, toaster, heating pad, and the like.

In some embodiments of the present invention, the one or more functional inserts of the cage-type tool may be sized small enough to fit within the cage body and allow the functional insert(s) to freely roll, bounce, or move within the cage as the cage-type tool is used on the hair. In other embodiments, the functional insert may be sized specifically to fit snugly within the cage body so that it does not roll and/or move within the cage. In another embodiment, the functional insert may partially protrude beyond the cage body.

The functional insert of the present invention may be shaped into any three-dimensional shape, including but not limited to round, cylindrical, triangular, or other polygon shapes, as well as custom or irregularly shapes. The shape of the cage body and the functional insert may be the same or may be different from one another.

In one embodiment of the cage-type tool, the functional insert is hollow. In another embodiment of the cage-type tool, the functional insert is solid. In a further embodiment of the cage-type tool, the functional insert is sponge-like, with pockets or holes located within and/or on the outer surface of the functional insert. In some examples of the present invention, the outer surface of the functional insert may be solid, a mesh, have perforations, and/or have variations in texture. In some embodiments, the outer surface of the functional insert has bristles, teeth, and/or mini posts located in whole or in part on said surface.

The functional insert of the present invention may be made of one or more any natural or man-made material, including but not limited to fabric, plastic, fiberglass, metal, rubber, composite, or carbon material components. In some embodiments of the cage-type tools where the tool is or can be heated, the functional insert may be of a heat-tolerant material. In another embodiment, the functional insert of a heatable cage-type tool may be made of heat-reflecting and/or heat-retaining materials that keep the tool warm and/or to enhance the original heating source of the tool.

Further embodiments of the cage-type tool of the present invention comprise functional inserts that can retain and release hair additives, including but not limited to water, air, moisture, steam, liquids, fragrances, gels, mousses, foams, conditioners, keratin, oils, sprays, volumizers, softening agents, powders, and the like. In some embodiments, the hair additives are contained within a permeable outer surface of the functional insert. In other embodiments, the functional insert is soaked, dipped, painted, infused, and/or covered by the hair additive. In further embodiments, the hair additives added to the functional insert may be replaceable. In other embodiments, the functional insert itself, including the hair additive(s), must be replaced. In some embodiments, the hair additives are added to the functional insert of the present invention in prescribed amounts or quantities to ensure proper and/or effective use of said hair additive.

BRIEF DESCRIPTION OF THE DRAWINGS

The features, nature, and advantages of the present disclosure will become more apparent from the detailed description set forth below when taken in conjunction with the drawings which correspond to the same.

DETAILED DESCRIPTION OF EMBODIMENTS

Figure 1:
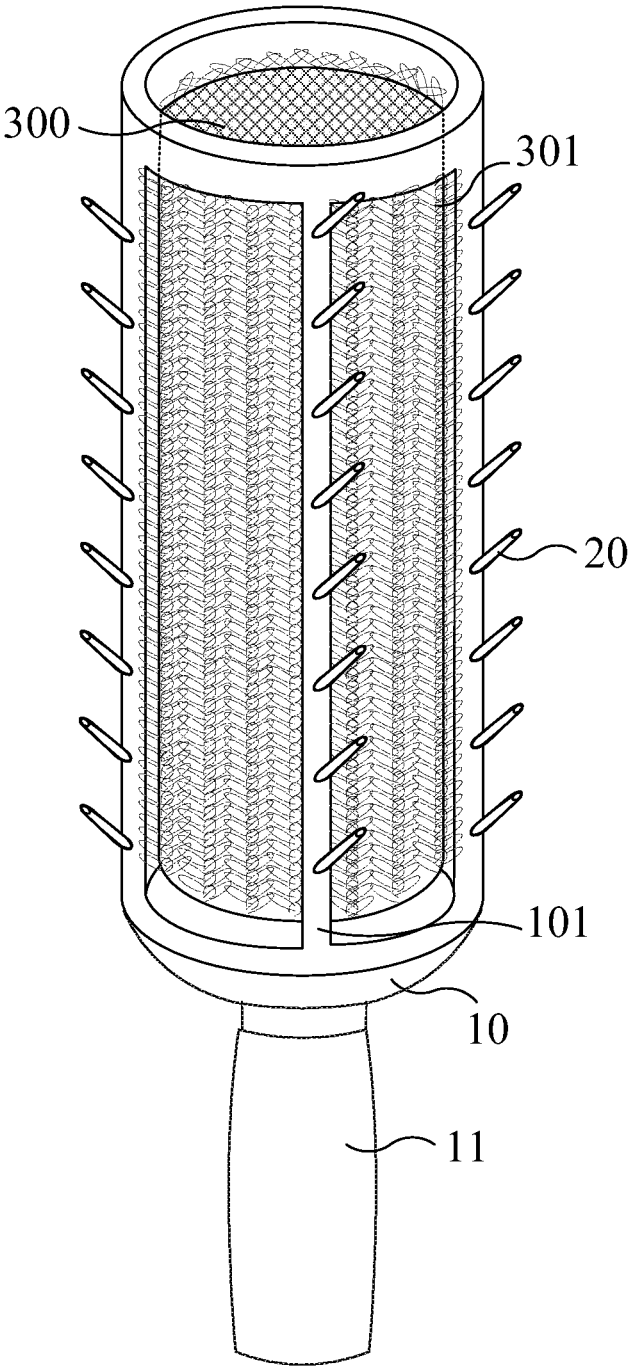
FIG. 1 illustrates an example of a cage-type tool of the present invention where the functional insert is smaller than the cage body such as to allow the functional insert to roll within the cage body. As depicted in FIG. 1, the outer surface of the cage body comprises bristles and the outer surface of the functional insert comprises mini posts that protrude intermittently as the cage-type tool is in use.

Reference will now be made in detail to the embodiments of the present disclosure, examples of which are illustrated in the accompanying drawings. The reference numerals used in the detailed description of the embodiment below correspond to the reference numerals used in the accompanying drawings.

The present invention encompasses cage-type tools comprising brushes, combs, and/or hair appliances, as depicted in the exemplary, non-limiting examples set forth in FIGS. 1-4.

FIG. 1 schematically illustrates a cage-type tool that is a hairbrush according to an embodiment of the present invention. The hairbrush includes a cage body 10, a handle 11 and a functional insert 300. The cage body 10 is integrally formed with or assembled to the handle 11, and may include elongated grids 101 as depicted. FIG. 1 provides just one example for the location of the grids 101 of the cage body 10; the cage body 10 may have grids 101 spaced and arranged in any fashion that will retain the functional insert 300 to be used within such cage body 10.

In further embodiments of the present invention, the cage body 10 may form only a portion of the cage-type tool in that other surfaces and/or structures may be present with the cage body, including but not limited to surfaces and/or structures containing additional bristles, teeth, mini posts, and surfaces and/or structures that provide power, hot air, heat, and the like.

In FIG. 1, on the outer surface of the grids 101 of the cage body, bristles 20 are optionally, selectively, or uniformly placed. Such bristles 20 may be integrally formed as part of the cage body and/or attached by any affixing or assembly process known in the art.

The functional insert 300 that is inserted into the cage body 10 of FIG. 1 has mini-posts 301 formed on the outer surface thereof. Alternative embodiments, not shown, include cage-type tools where multiple functional inserts 300 are inserted into the cage body 10.

As shown in FIG. 1, when the functional insert 300 is disposed inside the cage body 10, the mini-posts 301 may intermittently protrude out of the cage body 10 from the openings of the grids 101 of the cage body 10 during the brushing process. The mini-posts 301, for example, may or may not be comprised of mini-loops and/or mini-hooks like Velcro hooks and/or loops. The sizes, distributions, materials, and orientations of the mini-posts 301 are not to be limited as long as they are able to contact with hair and function well for smoothing, brushing, and or distributing a hair additive while the bristles 20 moves through hair. For example, because cuticle cells are generally differentially oriented, arbitrarily arranged mini-posts can smooth cuticle cells in a variety of orientations.

In the embodiment shown in FIG. 1, the functional insert 300 is formed of a hollow or solid cylinder and the mini-posts 301 are allocated on and stick out of the outer surface of the functional insert 300. It is to be noted that the diameter of the functional insert 300 in this embodiment is little smaller than that of the cage body 10 so that the functional insert 300 is free to roll, bounce, or otherwise move inside the cage body 10. As a result, when the bristles 20 pass through hair, especially to and fro, the moving functional insert 300 changes the direction of the mini posts, as well as the orientation of the hooks and/or loops when such structures are used as mini posts, which are in contact with hair. Such changes in direction and orientation improve the hair smoothing function of the mini posts and help prevent hair tangling. In some embodiments of the present invention, the protruding mini-posts should be soft or resilient enough in order to safely pass by the grids 101 without breaking when the functional plug 300 is rolling relative to the cage body 10.

The functional insert 300 does not have to include mini posts on its outer surface. In other embodiments not shown, the outer surface of the functional insert 300 may be smooth, solid, meshed, perforated, and/or have variations in texture. The outer surface of the functional insert 300 also may have bristles and/or teeth, alone or in combination with mini posts.

Figure 2A:
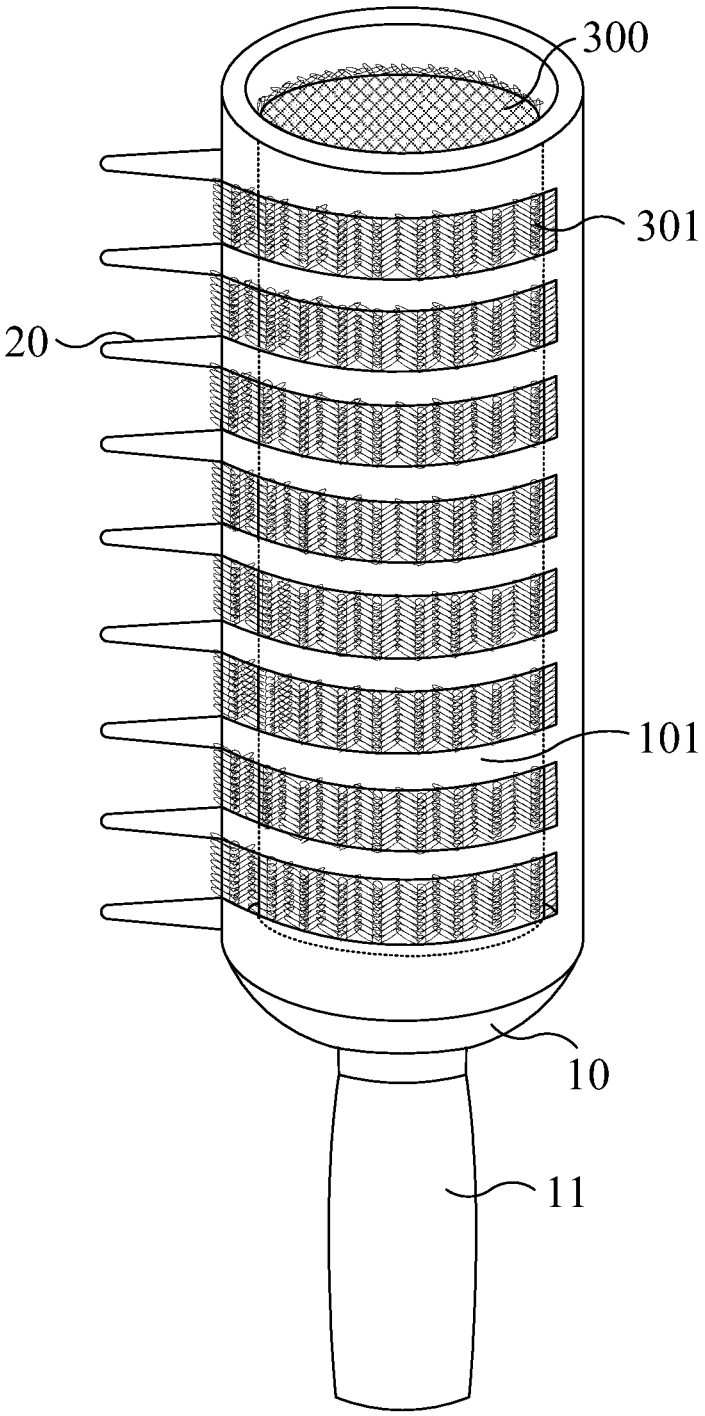
FIG. 2A illustrates a second example of a cage-type tool of the present invention where the functional insert is smaller than the cage body such as to allow the functional insert to roll within the cage body. As depicted in FIG. 2A, the cage body is formed so as to extend into protruding ends that serve as teeth or bristles. The outer surface of the functional insert comprises mini posts that protrude intermittently as the cage-type tool is in use.

FIG. 2A schematically illustrates a cage-type tool that is a comb according to another embodiment of the present invention. In this embodiment, the grids 101 of the cage body 10 are transversely arranged, and extend to have protruding ends serving as bristles/teeth 20. Similar to the embodiment illustrated in FIG. 1, the functional insert 300 shown in FIG. 2A is formed of a hollow or solid cylinder and the mini-posts 301 are allocated on and stick out of the outer surface of the functional insert 300. The diameter of the functional insert 300 in this embodiment is smaller than that of the cage body 10 so that the functional insert 300 is free to roll, bounce, or move inside the cage body 10. As a result, when the bristles/teeth 20 pass through hair, especially to and fro, the moving functional insert 300 changes the direction of the mini posts, as well as the orientation of the hooks and/or loops when such structures are used as mini posts, which are in contact with hair. Such changes in direction and orientation improve the hair smoothing function of the mini posts and help prevent hair tangling.

Figure 2B:
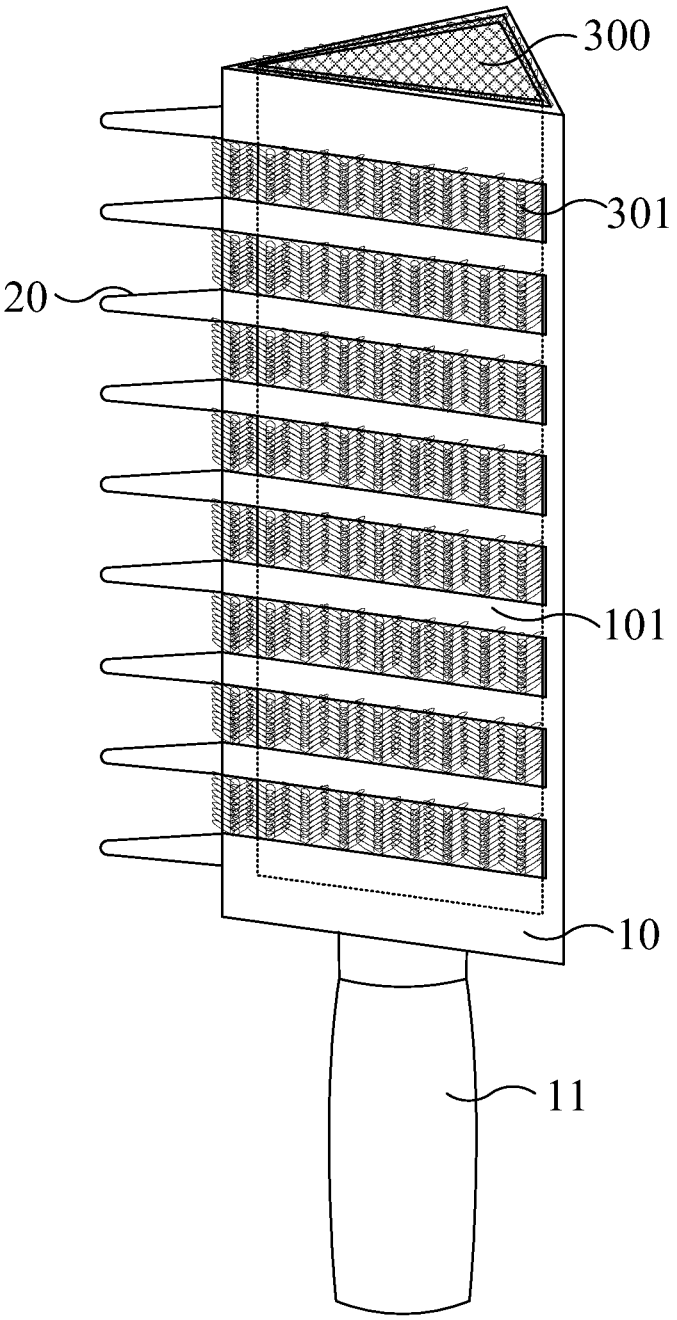
FIG. 2B illustrates an alternative example of a cage-type tool of the present invention where the functional insert and cage body are not cylindrical. The functional insert is smaller than the cage body, but the functional insert cannot rotate as freely within the cage body.

FIG. 2B schematically illustrates another alternative example of the cage-type tool that is a hair brush in which the cylindrical cage body 10 and cylindrical functional insert 300 of FIG. 2A has been replaced with triangular components. The cage body 10 and/or functional insert 300 of the present invention may take any three-dimensional shape, including but not limited to cylindrical, triangular, or other shapes not shown, such as polygon shapes, as well as custom or irregularly shapes. The shape of the cage body 10 and the functional insert 300 may be the same or the shapes of the cage body 10 and functional insert 300 may be different from one another (not shown).

Figure 3:
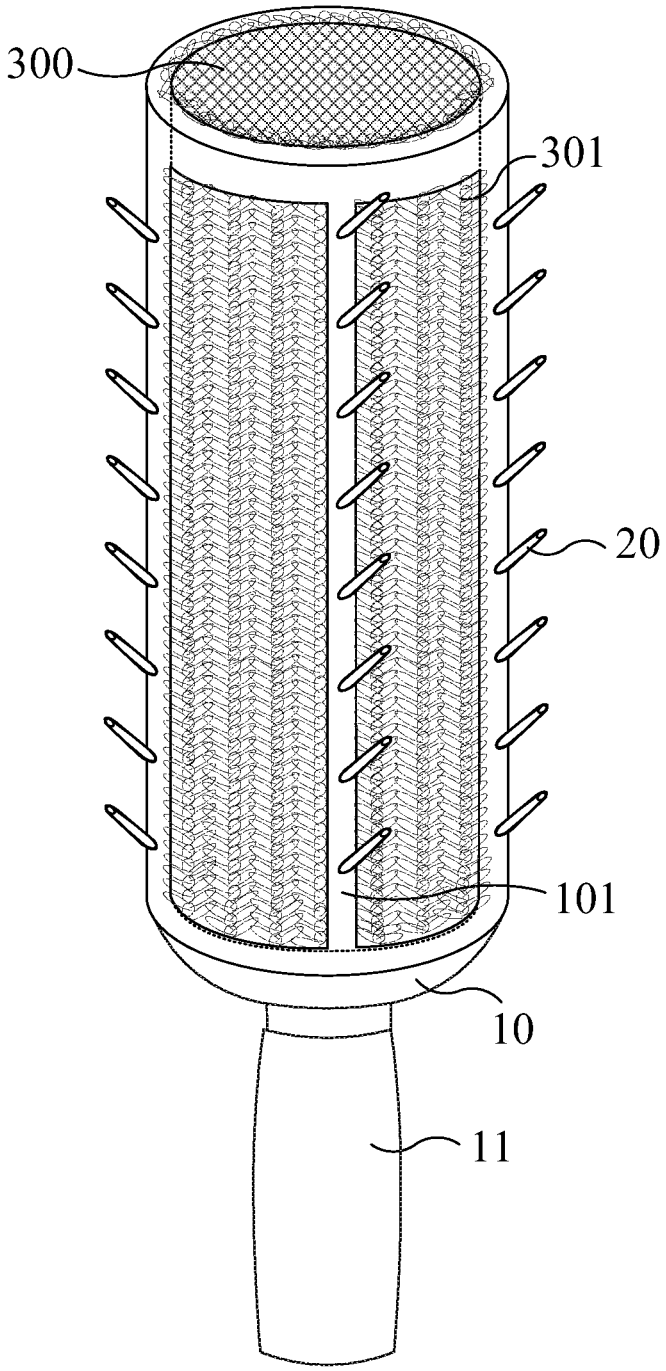
FIG. 3 and FIG. 4 illustrate an example of a cage-type tool where the functional insert is the same or greater size of the cage body and thus extends through the grid portions of the cage body.
Figure 4:
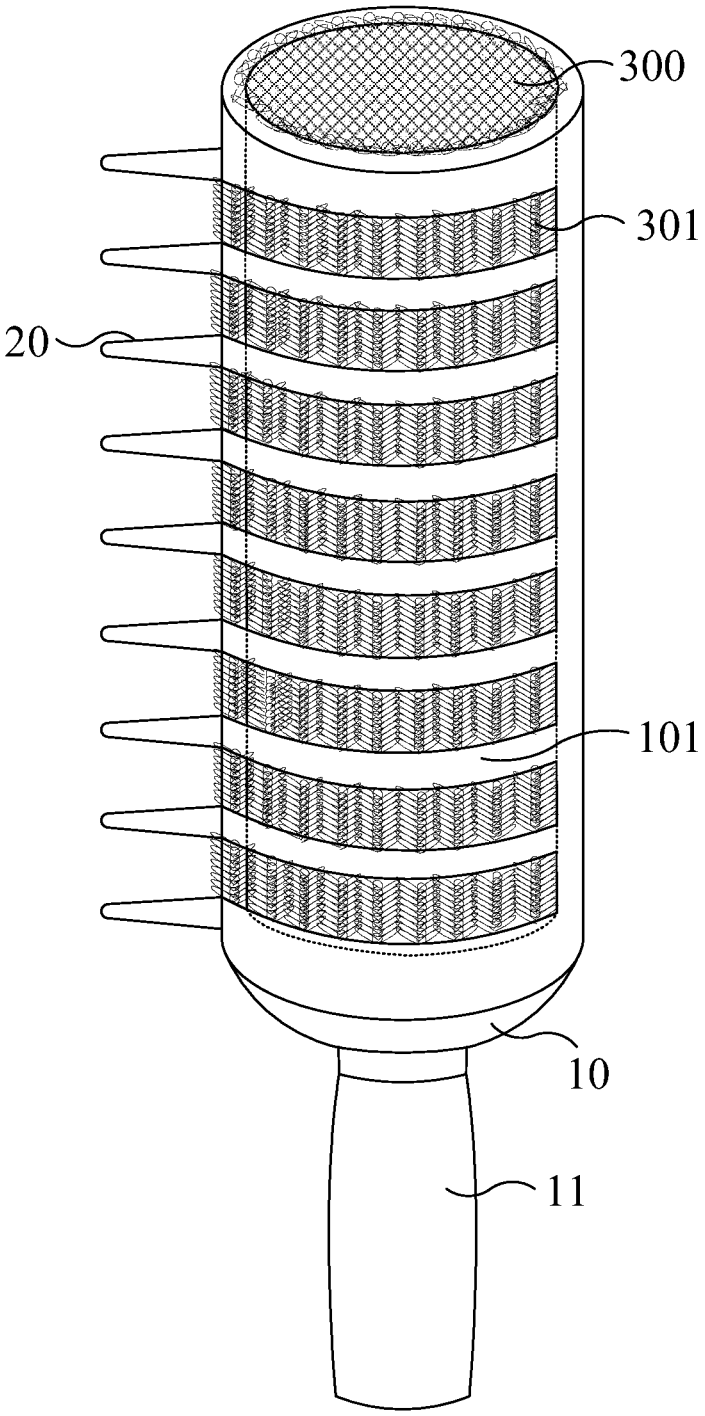

Further embodiments of cage-type brushes according to the present invention are schematically illustrated in FIG. 3 and FIG. 4. The functional insert 300 in FIG. 3 and FIG. 4 is made of a deformable and recoverable material and/or has a specific shape so that it can be forced into and become stuck inside the cage body 10. Such a functional insert 300 will not roll or move with the movement of the bristles 20 during hair brushing and combing. As shown in the embodiments of FIG. 3 and FIG. 4, the functional insert 300 may partially penetrate the openings of the grids 101. When the bristles 20 pass through hair, the functional insert 300 may function as a cushion or buffer for comforting the scalp.

While FIGS. 1-4 depict cage-type tools that are brushes and combs, the present invention further includes cage-type tools that are hair appliances having brush, comb, or mini post components, including but not limited to hot air hair brushes, curling irons with bristles, hair rollers, and heated hairbrushes and combs.

FIGS. 1-4 also depict embodiments of cage-type tools that do not have electricity or other power sources. In other embodiments, the cage-type tool may have traditional sources of power, such as a battery component, e.g., a traditional chemical battery and/or a rechargeable battery, or a solar powered battery source, or, alternatively, the cage-type tool may be chargeable via a standard electrical plug, a usb cord, charging mat, or other charging devices. In further embodiments, the cage-type tool may be heated or powered but may have no source of power of their own. As an example, the cage-type tool may be heated by exposing the appliance to hot air, including but not limited to being heated by a blow dryer, air brush, or oven, or by exposing the appliance to other known sources of heating, including but not limited to being heated by using a microwave, hot plate, oven, stove, toaster, heating pad, and the like.

The functional insert of the present invention may be made of one or more any natural or man-made material, including but not limited to fabric, plastic, fiberglass, metal, rubber, composite, or carbon material components. In some embodiments of the cage-type tool where the tool is or can be heated, the functional insert may be of a heat-tolerant material. In another embodiment, the functional insert of a heatable cage-type tool may be made of heat-reflecting and/or heat-retaining materials that keep the tool warm and/or to enhance the original heating source of the tool.

While not explicitly depicted in the illustrative figures, embodiments of the cage-type tool of the present invention include tools the functional inserts can retain and release hair additives, including but not limited to water, air, moisture, steam, liquids, fragrances, gels, mousses, foams, conditioners, keratin, oils, sprays, volumizers, softening agents, powders, and the like. In some such embodiments, the hair additives are contained within a permeable outer surface of the functional insert. In other embodiments, the functional insert is soaked, dipped, painted, infused, and/or covered by the hair additive. In further embodiments, the hair additives added to the functional insert may be replaceable. In other embodiments, the functional insert itself, including the hair additives, must be replaced. In some embodiments, the hair additives are added to the functional insert of the present invention in prescribed amounts or quantities to ensure proper and/or effective use of said hair additive.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular configurations of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

What is claimed is:

1. A cage-type tool comprising a cage body, a handle attached to or formed as part of the cage body, and one or more functional inserts positioned, in whole or in part, within said cage body, wherein mini loops and/or mini hooks are associated with at least a portion of the outer surface of at least one functional insert, wherein the cage body has at least one of (i) bristles, (ii) teeth, and/or (iii) mini posts, wherein the (i) bristles, (ii) teeth, and/or (iii) mini posts are associated with at least a portion of the outer surface of the cage body and are integrally formed with the cage body.

2. The cage-type tool of claim 1, further comprising one or more hair additives, wherein the one or more hair additives comprise at least one of water, air, moisture, steam, liquids, fragrances, gels, mousses, foams, conditioners, keratin, oils, sprays, volumizers, softening agents, and/or powders;

wherein the one or more hair additives are added to the outer surface of the at least one functional insert, wherein at least a portion of said outer surface is permeable; and wherein the at least one permeable functional insert retains and releases the one or more hair additives.

3. The cage-type tool of claim 1, wherein the tool is at least one of a brush, comb, and/or hair appliance containing bristles or teeth.

4. The cage-type tool of claim 3, wherein the cage body forms only a part of the cage-type tool that retains the one or more functional inserts;

wherein the remainder of the cage-type tool that retains the one or more functional insert comprises a surface of the cage-type tool to which the cage body is attached.

5. The cage-type tool of claim 1, wherein a hair appliance is at least one of a heated hairbrush, a hot air brush and hair dryer, and/or a curling iron.

6. The cage-type tool of claim 1, wherein the one or more functional inserts are smaller than the cage body.

7. The cage-type tool of claim 6, wherein the one or more functional inserts move within the cage body during hair styling, and wherein the mini loops and/or mini hooks on the outer surface of the one or more functional inserts intermittently penetrate the hair at more than one angle while moving within the cage body during hair styling.

8. The cage-type tool of claim 6, further comprising one or more hair additives, wherein the one or more hair additives comprise at least one of water, air, moisture, steam, liquids, fragrances, gels, mousses, foams, conditioners, keratin, oils, sprays, volumizers, softening agents, and/or powders;

wherein the one or more hair additives are added to the outer surface of the at least one functional insert, wherein at least a portion of said outer surface is permeable; and wherein the at least one permeable functional insert retains and releases the one or more hair additives.

9. The cage-type tool of claim 1, wherein the one or more functional inserts are the same size or greater than the cage body.

* * * * *